US006324774B1

(12) United States Patent
Zebe, Jr.

(10) Patent No.: US 6,324,774 B1
(45) **Date of Patent: *Dec. 4, 2001**

(54) SHOELACE RETAINING CLIP AND FOOTWEAR CLOSURE MEANS USING SAME

(76) Inventor: Charles W. Zebe, Jr., 201 Glen Brook Pl., Hightstown, NJ (US) 08520

( * ) Notice: Subject to any disclaimer, the term of this patent is extended or adjusted under 35 U.S.C. 154(b) by 0 days.

This patent is subject to a terminal disclaimer.

(21) Appl. No.: 09/504,144

(22) Filed: Feb. 15, 2000

(51) Int. Cl.[7] ..... A43C 11/08
(52) U.S. Cl. ..... 36/50.1; 24/712.7; 24/712.9
(58) Field of Search ..... 36/50.1, 50.5; 24/712.4, 712.7, 712.9

(56) References Cited

U.S. PATENT DOCUMENTS

| | | |
|---|---|---|
| D. 29,919 | 1/1899 | Tremble . |
| D. 30,652 | 5/1899 | Pardee et al. . |
| D. 166,328 | 4/1952 | Maring . |
| D. 170,787 | 11/1953 | Wood . |
| D. 224,584 | 8/1972 | Parpaiola et al. . |
| 511,326 | 12/1893 | DeLong et al. . |
| 630,984 | 8/1899 | Lovell . |
| 1,792,923 | 2/1931 | O'Neil . |
| 2,287,985 | 6/1942 | Gookin . |
| 3,112,545 | 12/1963 | Williams . |
| 3,333,304 | 8/1967 | Daddona, Jr. . |
| 3,834,048 | 9/1974 | Maurer . |
| 3,936,914 | 2/1976 | Mancini . |
| 4,071,964 | 2/1978 | Vogiatzis . |
| 4,633,548 | 1/1987 | Siskind et al. . |
| 4,916,833 | 4/1990 | Nwoko . |
| 5,181,331 | 1/1993 | Berger . |
| 5,345,697 | 9/1994 | Quellais . |
| 5,526,585 | 6/1996 | Brown et al. . |
| 5,537,763 | 7/1996 | Donnadieu et al. . |
| 5,566,474 | 10/1996 | Leick et al. . |
| 5,640,785 | 6/1997 | Egelja . |
| 5,647,104 | 7/1997 | James . |
| 5,755,044 | 5/1998 | Veylupek . |
| 5,848,457 | 12/1998 | Silagy . |
| 5,906,057 | 5/1999 | Borsoi . |
| 5,909,947 | 6/1999 | DeMarchi . |
| 5,926,976 | 7/1999 | Cretinon et al. . |
| 5,940,990 | 8/1999 | Barret . |
| 5,956,823 | 9/1999 | Borel . |
| 5,966,841 | 10/1999 | Barret . |
| 5,979,080 | 11/1999 | Borsoi . |
| 5,996,256 | 12/1999 | Zebe, Jr. . |

*Primary Examiner*—Ted Kavanaugh
(74) *Attorney, Agent, or Firm*—Sperry, Zoda & Kane

(57) ABSTRACT

A retaining clip for holding shoelaces and replacing standard footwear eyelets including one integral member formed with a base attached to the shoe upper with a curved member extending upwardly therefrom and an upper member extending back across the base. An abutment member extends outwardly from the upper member toward the base member to be in abutment therewith for retaining a shoelace therewithin and a prying tab extends upwardly from the abutment member. The shoelace when urged against the prying tab will cause the abutment member to separate from the base allowing the shoelace to snap into place. When the shoelace is pulled against the opposite side of the abutment member, release is achieved. The footwear construction includes a shoelace securement means having a cam cleat for firmly gripping of the shoelaces and facilitating extremely rapid operation of the overall footwear closure construction.

20 Claims, 1 Drawing Sheet

SHOELACE RETAINING CLIP AND FOOTWEAR CLOSURE MEANS USING SAME

BACKGROUND OF THE INVENTION

1. Field of the Invention

The present invention deals with the field of footwear closure configurations and particularly provides a shoewear closure means usable for persons who would wish to have a quick and easy to close footwear closure securement means. Preferred is two cam cleats, wherein the shoewear design does not require any tieing of the laces and does not require placing of the lace through a successive series of individual eyelets. The high speed securement clips provided along with the cam cleats and the supplemental securement clips provide a very high speed and very secure foot securement construction.

2. Description of the Prior Art

Many prior art devices have been covered by previously issued patents designed primarily for the purpose of providing various types of apparatus for footwear such as boots, shoes, tennis shoes and the like for the purposes of tightening the lacing thereof in order to close the foot gripping opening and secure the footwear with respect to the foot of a wearer such as shown in U.S. Pat. No. 630,984 patented Aug. 15, 1899 to Lovell on a "Guard For Lacing Hooks"; and U.S. Pat. No. 2,287,985 patented Jun. 30, 1942 to Gookin and assigned to United Shoe Machinery Corporation on a "Laced Boot"; and U.S. Pat. No. 3,112,545 patented Dec. 3, 1963 to Williams on a "Shoe Fastening Device"; and U.S. Pat. No. 3,262,167 patented Jul. 26, 1966 to H. Martin on a "Closure For Footwear Having Interconnected Rotatable Members"; and U.S. Pat. No. 3,279,015 patented Oct. 18, 1966 to L. M. Henning and assigned to Byron V. Curry, William J. Gribble and N. S. Henning on a "Shoelace Apparatus"; and U.S. Pat. No. 3,333,304 patented Aug. 1, 1967 to Daddona, Jr. and assigned to Scovill Manufacturing Company on a "Lacing Device"; and U.S. Pat. No. 3,425,408 patented Feb. 4, 1969 to M. Vinet and assigned to Vapor Corporation on a "Track Switch Heater"; and U.S. Pat. No. 3,490,156 patented Jan. 20, 1970 to P. Lollmann et al and assigned to Rieker & Co. on "Sports Footwear"; and U.S. Pat. No. 3,703,775 patented Nov. 28, 1972 to J. Gouda on "Football Boots"; and U.S. Pat. No. 3,808,644 patented May 7, 1974 to R. Schoch and assigned to Weinmann Aktiengesellschaft on a "Closure Device For Shoes, Particularly For Ski Shoes"; and U.S. Pat. No. 3,834,048 patented Sep. 10, 1974 to Maurer on "Shoe Fastening"; and U.S. Pat. No. 4,071,964 patented Feb. 7, 1978 to Vogiatzis on a "Footwear Fastening System"; and U.S. Pat. No. 4,326,320 patented Apr. 27, 1982 to T. Riedel and assigned to Sesamat Anstalt on a "Lever-Operable Fastener For A Shoe"; and U.S. Pat. No. 4,633,548 patented Jan. 6, 1987 to Siskind et al on a "Speed Lace Structure"; and U.S. Pat. No. 4,640,025 patented Feb. 3, 1987 to J. DeRenzo on a "Figure Eight Shoe Tie System"; and U.S. Pat. No. 4,907,352 patented Mar. 13, 1990 to J. Ginsberg on a "Shoe Lace Replacing And Shoe Fastening Device"; and U.S. Pat. No. 4,916,833 patented Apr. 17, 1990 to Nwoko on an "Enhanced Speed Lacing Device With An Integrated Adjustable Width, Adjustable Tension System"; and U.S. Pat. No. 5,177,882 patented Jan. 12, 1993 to C. Berger and assigned to PUMA AG Rudolf Dassler Sport on a "Shoe With A Central Fastener"; and U.S. Pat. No. 5,181,331 patented Jan. 26, 1993 to C. Berger and assigned to Puma Rudolf Dassler Sport on a "Shoe With Flexible Upper Material Provided With A Closing Device"; and U.S. Pat. No. 5,205,055 patented Apr. 27, 1993 to A. Harrell on a "Pneumatic Shoe Lacing Apparatus"; and U.S. Pat. No. 5,333,398 patented Aug. 2, 1994 to Y. Seo on a "Lace Fastening Cleat And Shoe"; and U.S. Pat. No. 5,345,697 patented Sep. 13, 1994 to Quellais and assigned to Salomon S. A. on a "Boot Tightened By A Flexible Link"; and U.S. Pat. No. 5,349,764 patented Sep. 27, 1994 to S. Posner and assigned to Dan Lynn Industries, Inc. on a "Shoe Securement Apparatus"; and U.S. Pat. No. 5,526,585 patented Jun. 18, 1996 to Brown et al on an "Attachment Device For Use With A Lace-Substitute Hand-Actuable Shoe-Closure System"; and U.S. Pat. No. 5,537,763 patented Jul. 23, 1996 to T. Donnadieu et al and assigned to Salomon S. A. on a "Boot With Tightening System With Memorization Of Tension"; and U.S. Pat. No. 5,566,474 patented Oct. 22, 1996 to Leick et al and assigned to Salomon S. A. on a "Sport Boot Having A Fixed-Lace Closure System"; and U.S. Pat. No. 5,640,785 patented Jun. 24, 1997 to S. Egelja and assigned to Items International, Inc. on "Resilient Loops And Mating Hooks For Securing Footwear To A Foot"; and U.S. Pat. No. 5,647,104 patented Jul. 15, 1997 to Laurence H. James and assigned to Laurence H. James on a "Cable Fastener"; and U.S. Pat. No. 5,755,044 patented May 26, 1998 to Veylupek on a "Shoe Lacing System"; and U.S. Pat. No. 5,848,457 patented Dec. 15, 1998 to Silagy on a "Lacing System For Traditional Footwear"; and U.S. Pat. No. 5,906,057 patented May 25, 1999 to Borsoi and assigned to Salomon S.A. on a "Sports Boot Including Flexible And Traction Resistant Return Elements"; and U.S. Pat. No. 5,909,947 patented Jun. 8, 1999 to DeMarchi and assigned to Salomon S.A. on a "Sport Footwear Assembly"; and U.S. Pat. No. 5,926,976 patented Jul. 27, 1999 to Cretinon et al and assigned to Salomon S. A. on a "Sport Boot"; and U.S. Pat. No. 5,940,990 patented Aug. 24, 1999 to Barret and assigned to Salomon S. A. on a "Shoe With An At Least Partially Elastic Lining And Volume Adjusting System"; and U.S. Pat. No. 5,956,823 patented Sep. 28, 1999 to Borel and assigned to Salomon S. A. on a "Guide and Blocking Assembly For A Boot"; and U.S. Pat. No. 5,979,080 patented Nov. 9, 1999 to Borsoi and assigned to Salomon S. A. on a "Lace Having Variable Sections For Sports Boots And Sports Boot Equipped With Such A Lace"; and U.S. Pat. No. 5,996,256 patented Dec. 7, 1999 to Charles W. Zebe, Jr. on "Footwear Construction With Improved Closure Means".

SUMMARY OF THE INVENTION

The present invention provides a unique configuration for a shoelace retaining clip allowing the lacing of a shoe or re-lacing of a shoe to be preformed quickly by preventing the necessity of extending the lacing through numerous individual holes or eyelets. The configuration of the shoelace retaining clip includes a base member which defines at least one mounting eyelet therein in order to facilitate securement thereof with respect to the footwear upper surface. An arcuate intermediate member is integral with the base member and extends outwardly away therefrom. This arcuate inner member is flexibly resilient preferably and includes a convexly curved interior wall section therein in order to minimize the damaging of a shoelace retained securely therein by limiting any sharp edges over which the lacing must extend.

An upper member is also included integral with the arcuate intermediate member and extending outwardly therefrom to a position spatially disposed from and yet extending over the base member in such a manner as to define a shoelace retaining hole. This shoelace retaining hole preferably is positioned adjacent to the convexly curved interior wall section in order to minimize damaging thereof by preventing the passing thereof over any sharp edges. This upper member is also preferably formed of a flexibly resilient material. An abutment member is also integral with respect to the upper member and extends outwardly away therefrom toward the base member in order to abut the base member at a position remote from the location of the arcuate intermediate member. In this manner the shoelace retaining hole means will be defined between the base member and the upper member in a vertical direction and between the arcuate intermediate member and the abutment member in the horizontal direction. The abutment member is preferably biased into abutment with the base member in the steady state position by the flexible resilience of the configuration of the arcuate intermediate member and the upper member.

A prying tab may also be included preferably extending outwardly with respect to the abutment member in a direction away from the base member in order to define a prying slot therebetween facing outwardly away from the shoelace retaining hole. This prying tab preferably extends at an acute angle of approximately 45% away from the base member to facilitate leverage of force biased against the prying tab. The prying tab is responsive to a force being exerted thereon by a shoelace being forcibly urged into the prying slot to move away from the base member and to urge movement of the abutment member away from contact with the base member to allow entry of the shoelace into the shoelace retaining hole to be removably retained therewithin.

This unique configuration for a shoelace securement means is preferably utilized with a footwear construction which includes a footwear sole extending below the foot of wearer and a footwear upper attached to the footwear sole and extending upwardly therefrom around the foot of a wearer. This footwear upper preferably defines a foot opening therein to allow entry and exit of the foot of a wearer. The footwear upper also preferably defines an elongated lacing gap extending therealong and adjacent the foot opening to facilitate entry and exit of the foot of a wearer into the footwear upper. A shoelace is also preferably included which is attachable with respect to the footwear upper along the elongated lacing gap for tightening thereof for selectively securing the footwear upper about the foot of a wearer.

Preferably the shoelace securement means will include a first cam cleat and a second cam cleat for detachably securing the shoelace with respect to the shoe upper without requiring the shoelace to be tied to itself. Also it is preferable that supplemental shoelace retaining clips be included behind each of the cam cleats to allow the extra portion of the shoelace not used for securement of the elongated lacing opening to be firmly secured with respect to the shoe upper. To further facilitate this securement an enlarged end portion may be preferably included in the shoelace of a size larger than the retaining aperture for the shoelace defined in the supplemental clip means.

It is an object of the footwear closure apparatus and shoelace retaining clip of the present invention to provide a "bowless" shoelace tightening configuration which is both simple as well as relative inexpensive.

It is an object of the footwear closure apparatus and shoelace retaining clip of the present invention to provide a "bowless" shoelace tightening configuration wherein tightening of footwear is achieved by extending the shoelace thereof through a plurality of high speed clips or hooks to provide an overall enhanced and high speed shoe tightening mechanism.

It is an object of the footwear closure apparatus and shoelace retaining clip of the present invention to provide a "bowless" shoelace tightening configuration wherein attachment about the foot of a wearer is enhanced by preventing the laces on any kind of shoe from becoming loose which would cause the user to step on, trip over or entangle these loose laces and possibly result in serious injury.

It is an object of the footwear closure apparatus and shoelace retaining clip of the present invention to provide a "bowless" shoelace tightening configuration wherein a safe shoe securement apparatus is provided by firming securing any excess shoelace material.

It is an object of the footwear closure apparatus and shoelace retaining clip of the present invention to provide a "bowless" shoelace tightening configuration wherein attachment of a shoe to the foot of a wearer is enhanced for young children and other persons which have difficulty tieing shoelaces.

It is an object of the footwear closure apparatus and shoelace retaining clip of the present invention to provide a "bowless" shoelace tightening configuration wherein re-lacing of a shoe is capable of being performed in a much more rapid fashion.

It is an object of the footwear closure apparatus and shoelace retaining clip of the present invention to provide a "bowless" shoelace tightening configuration wherein the cost of manufacture is minimized.

It is an object of the footwear closure apparatus and shoelace retaining clip of the present invention to provide a "bowless" shoelace tightening configuration wherein invalids and other persons with debilitating problems such as arthritis can more easily put on their own shoes.

It is an object of the footwear closure apparatus and shoelace retaining clip of the present invention to provide a "bowless" shoelace tightening configuration wherein the re-lacing as well as tightening of shoelaces is made much more simple and quick to perform.

It is an object of the footwear closure apparatus and shoelace retaining clip of the present invention to provide a "bowless" shoelace tightening configuration wherein usage with various different types of footwear configuration is made possible.

It is an object of the footwear closure apparatus and shoelace retaining clip of the present invention to provide a "bowless" shoelace tightening configuration wherein more accurate control of the tension and securement of shoelaces with respect to a footwear upper is achieved.

It is an object of the footwear closure apparatus and shoelace retaining clip of the present invention to provide a "bowless" shoelace tightening configuration wherein the undesirable loosening of shoelaces is prevented by the firm securement with respect to the high speed clipping system, cam cleats and supplemental clipping arrangement shown herein.

It is an object of the footwear closure apparatus and shoelace retaining clip of the present invention to provide a "bowless" shoelace tightening configuration wherein it is not necessary to make perforations extending through a conventional footwear upper to form eyelets therein thereby enhancing waterproof characteristics of footwear made with this configuration.

It is an object of the footwear closure apparatus and shoelace retaining clip of the present invention to provide a "bowless" shoelace tightening configuration wherein shoelaces do not at any point extend below the uppermost surface of the shoe upper.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
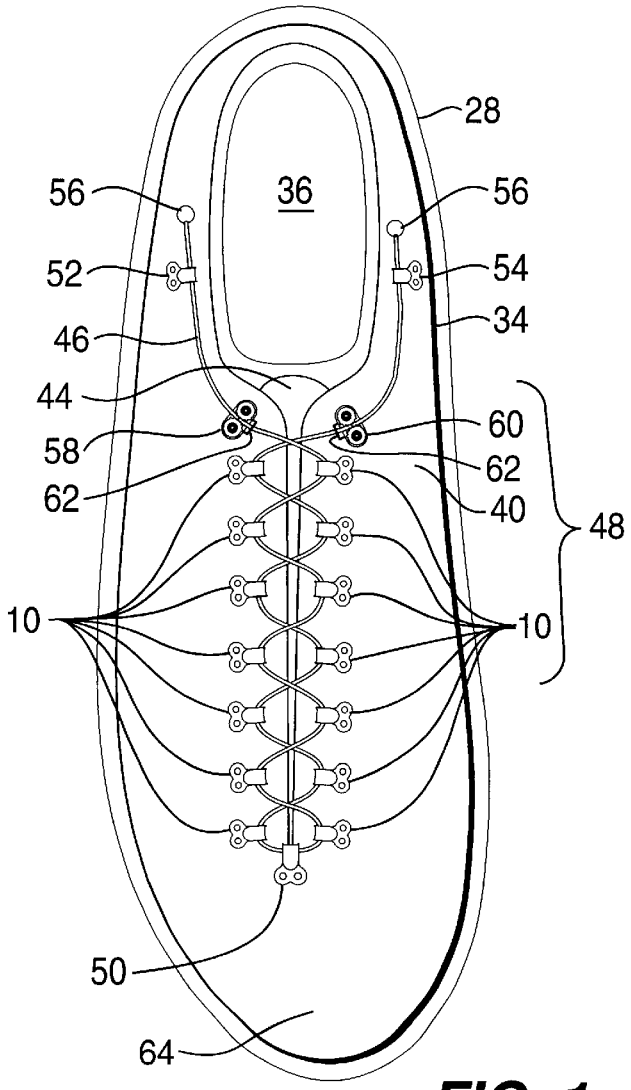
FIG. 1 is a top plan view of an embodiment of a footwear construction of the present invention showing the improved closure apparatus used with the improved shoelace retaining clips of the present invention.
Figure 2:
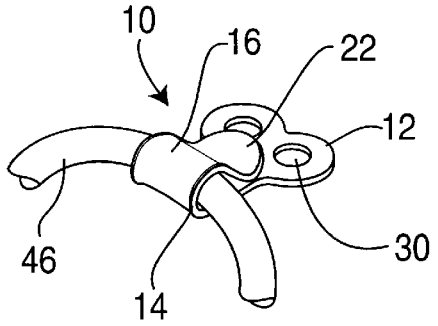
FIG. 2 is a perspective illustration of an embodiment of the shoelace retaining clip of the present invention shown with a shoelace retained therewithin.

The present invention provides a new and improved shoelace retaining clip configuration 10 which preferably includes a base member 12 securable to a conventional footwear upper 40. Base member 12 preferably defines one or more preferably two individual mounting eyelets 30 which can receive rivets or other securement means for fixedly attaching the base member 12 of the shoelace retaining clip 10 with respect to the footwear upper 40. A conventional footwear 34 such as a shoe, boot or tennis shoe will define a foot opening 42 designed for receiving the foot 36 of a wearer extending therethrough. It also includes a sole 38 extending below the footwear to encapsulate the user's foot 36. An elongated lacing gap 44 extends outwardly from the foot opening 42 along the footwear upper 40 to facilitate entry and removal of the foot 36 of a wearer into the footwear 34.

This elongated lacing gap 44 needs to be secured by a shoelace 46. Attachment of the shoelace 46 with respect to each side of the elongated lacing gap 44 is achieved by the shoelace retaining clip 10 of the present invention. With the base 12 of each of the shoelace retaining clips 10 secured at spaced relation with respect to one another along both sides of the lacing gap 44 an improved lacing configuration is provided.

In particular the shoelace securement means 48 provided by the present invention will preferably include multiple shoe retaining clips 10 with their base member 12 secured to the footwear upper 40 along both opposite sides of the elongated lacing gap 44 as well as a lowermost shoelace retaining clip 50 positioned below the end of the elongated lacing gap 44 immediately behind the toe area 64 of the shoe.

The detailed configuration of the shoe retaining clip 10 of the present invention to form this overall improved shoelace securement configuration 48 is a very important aspect of the present invention. In particular an arcuate intermediate member 14 is included extending upwardly from the base member 12. An upper member 16 is attached to the arcuate intermediate member 14 and extends outwardly therefrom over the base member 12 at a position spatially disposed therefrom. An abutment member 20 extends from the upper member 16 toward the base member 12 in such a manner as to be brought into abutment therewith. The base member 12, the arcuate intermediate member 14, the upper member 16 and the abutment member 20 are preferably formed as a single integral unit formed of a flexibly resilient material. Preferably this material would be a spring steel such as a blue spring steel or stainless spring steel. The base member 12 and the upper member 16 define the lower and upper limits, respectively, of a shoelace retaining hole 18. In a similar manner the abutment member 20 and the arcuate intermediate member 14 define the lateral limits of the shoelace retaining hole 18. As such, base member 12, arcuate intermediate member 14, upper member 16 and abutment member 20 together define a shoelace retaining hole 18 extending therethrough which is defined to selectively retain or release a shoelace 46 easily and rapidly as desired by a user.

Figure 4:
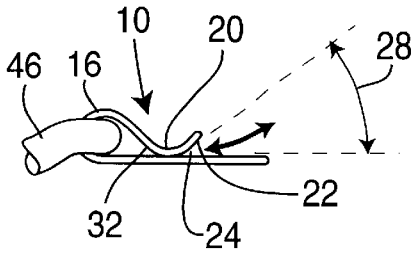
FIG. 4 is a side plan view of an embodiment of the shoelace retaining clip of the present invention shown with a shoelace retained therewithin.

To facilitate operation of the shoelace retaining clip 10 a prying tab 22 will extend upwardly away from the abutment member 20. Such prying tab 22 will preferably be integral with the abutment member 20 and will define a prying slot 24 along with the base member 12. That is, base member 12 and prying tab 22 which extends upwardly at an acute angle from the base member 12 will define this prying slot 24 therebetween. The 45% angle 28 at which the prying tab 24 is preferably configured with respect to the base member 12 is shown best in FIG. 4.

Figure 3:
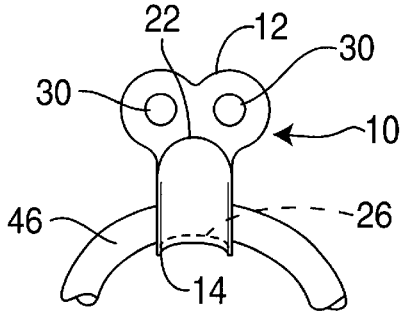
FIG. 3 is a top plan view of an embodiment of the shoelace retaining clip of the present invention shown with a shoelace retained therewithin.

When the shoelace 46 is placed within the shoelace retaining hole 18 it is preferable that the arcuate intermediate member 14 include a convexly curved interior wall section 26. This is shown best in FIG. 3. Normally the shoelace 46 will extend away from the mounting eyelets 30 of the clip 10 and, as such, it is preferable that sharp or form edges be rounded over to prevent wear or damage to the shoelace 46 itself. This is achieved by forming of the interior wall of the arcuate intermediate member 14 with a convexly curved interior wall section 26.

Figure 6:
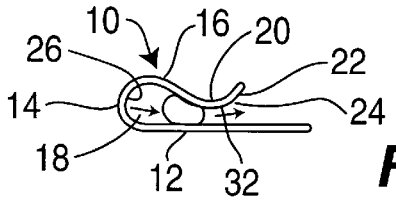
FIG. 6 is a side cross-sectional view showing a shoelace exerting biasing against a tab as it is removed from the embodiment of the shoelace retaining clip of the present invention.

Also preferably the abutment member 20 will include a convexly shaped abutment surface 32 to facilitate maintaining a firm contact thereof with respect to the base member 12 when the abutment member 20 is biased in the steady state position in contact therewith. In the normal configuration due to the flexible resilience in the materials of which the elements of the spring retaining clip 10 of the present invention are made, the convexly shaped abutment surface 32 of the abutment member 20 will be biased into contact with the base member 12. This biasing force will help retain the shoelace 46 within the shoelace retaining hole 18. However, if it is desired to remove the shoelace 46 from this hole 18, this can be quickly achieved merely by exerting force upon the shoelace in the upper direction as shown in FIG. 1 which will cause force to be exerted against the abutment member 20 causing it to separate from abutment with the base member 12 by overcoming the spring resilient force urging these members to separate allowing release of the shoelace as shown in FIG. 6.

Figure 5:
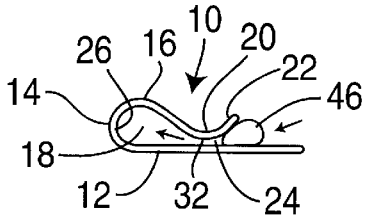
FIG. 5 is a side cross-sectional view showing a shoelace exerting biasing against a tab as it is inserted into an embodiment of the shoelace retaining clip of the present invention.
Figure 7:
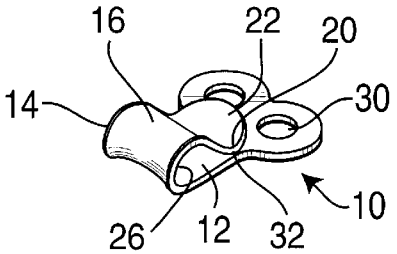
FIG. 7 is a perspective illustration of an embodiment of the shoelace retaining clip of the present invention.

This same flexible resilience can be overcome in order to place the shoelace 46 in position retained within the shoelace retaining hole 18 as shown in FIG. 5. In this drawing we see that the shoelace 46 is being urged to the left, that is, urged into the prying slot 24. As the shoelace is brought in contact with the prying tab 22 it exerts a bias against this tab and against the base member 12 therebelow causing the prying tab 22 to be pried away from the base member 12 as shown in FIG. 5. This allows the shoelace 46 to be quickly snapped into position within the shoelace retaining hole 18. As soon as the shoelace 46 enters the hole 18 the abutment member 20 snaps back to the steady state position in abutment with the base member 12 due to the flexible resilience of the various members of the shoelace retaining clip 10.

The advantages of this configuration are clearly appreciated when comparing this quick snap in and snap out high speed clipping configuration to the time consuming and onerous process of threading a shoelace through a plurality of as many as fourteen or more individual shoelace holes defined in the footwear upper 40 along the elongated lacing gap 44. This is an advantage in speed of attachment and disengagement which is useful for retaining any type of string or lacing configuration and such use is contemplated in accordance with the present invention.

To further provide a fast and convenient shoelace securement apparatus 40 for the present invention it may further include a first cam cleat 58 and a second cam cleat 60 as shown in FIG. 1. The use of these cam cleats as an apparatus for footwear securement to replace the requirement of tying the shoelaces was first disclosed in U.S. Pat. No. 5,996,256 filed Feb. 26, 1998 as Ser. No. 09/031,034 by the same inventor as herein. The entire text of that issued patent is now incorporated by reference into the present application. With the positioning of a cam cleat 58 and 60 on each opposite side of the elongated lacing gap 44 high speed tightening of the laces is achievable immediately after high speed lacing of the shoes using the improved shoelace retaining clip 10 of the present invention. Such cam cleats 58 and 60 are enhanced in operation by the inclusion of a guide ring 62 therewith which holds the shoelace 46 in position at all times such that it is extending through each of the cam cleats.

To further enhance the convenience and safety of use of the shoelace securement apparatus 48 of the present invention, a first supplemental shoelace retaining clip 52 will be positioned immediately behind the first cam cleat 58 and a second supplemental shoelace retaining clip 54 will be positioned immediately behind the second cam cleat 60. In this manner any extra lacing which is left over after tightening of the laces by tying thereof or by securement to the cam cleats can be retained closely and securely and safely along the lateral sides of the footwear upper 40 immediately adjacent to the foot opening 42. Each of the supplemental shoelace retaining clips will adopt the same basic configuration as the shoelace retaining clips 10 utilized along both sides of the elongated lacing gap 44 to facilitate speed of securement therebetween. Also preferably the shoelace 46 will include enlarged end members 56 which will prevent the ends of the shoelace from passing through the shoelace retaining holes 18 defined in the supplemental shoelace retaining clips 52 and 54. In order to achieve this reliable attachment the size of the enlarged end members 56 must be larger than the diameter of the shoelace retaining hole 18.

With this configuration the present invention discloses a unique configuration for a lacing retaining clip and a unique configuration utilizing this clip with respect to footwear. Neither of these combinations are shown or suggested in any of the prior art. As such, the present invention is deemed to be a distinct advantage over prior art footwear securement designs currently available.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A footwear construction with improved closure means for selective tightening thereof for facilitating attachment about the foot of wearer, said footwear means comprising:

A. a footwear sole means adapted to extend below the foot of a wearer;

B. a footwear upper means attached to said footwear sole means and extending upwardly therefrom around the foot of the wearer, said footwear upper means defining a foot opening means therein to allow entry and exit of the foot of a wearer therewithin, said footwear upper means also defining an elongated lacing gap means extending therealong and adjacent the foot opening defined therein to facilitate entry and exit of the foot of a wearer within the footwear upper means;

C. a shoelace means attachable with respect to said footwear upper means along said elongated lacing gap means for tightening thereof for selectively securing the footwear upper means about the foot of a wearer; and D. a shoelace securement means attached to said footwear upper means adjacent said elongated lacing gap means thereof for receiving and detachably securing said shoelace means in a tightened position for retaining said elongated lacing gap means selectively retained, said shoelace securement means including:

(1) at least one shoelace retaining clip means comprising:

(a) a base member;

(b) an arcuate intermediate member extending outwardly away from said base member;

(c) an upper member extending outwardly away from said arcuate intermediate member to a position both spatially disposed from and extending over said base member to define therebetween a shoelace retaining hole means;

(d) an abutment member extending outwardly away from said upper member toward said base member and in abutment therewith at a position spatially disposed from said arcuate intermediate member to further define said shoelace retaining hole means therebetween;

(e) a prying tab means extending outwardly from said abutment member in a direction away from said base member to define a prying slot means therebetween facing outwardly away from said shoelace retaining hole means, said prying tab means being responsive to a force being exerted thereon by a shoelace forcibly urged into said prying slot means to move away from said base member and to cause movement of said abutment member away from contact with said base member to allow entry of a shoelace into said shoelace retaining hole means to be removably retained therewithin; and (2) at least one cam cleat means including a pair of pivotal members being relatively pivotally movable and positioned adjacently and adapted to selectively grip and retain said shoelace means extending therebetween for selectively tightening thereof across said elongated lacing gap means to retain the footwear means about the foot of a wearer.

2. A shoelace retaining clip means as defined in claim 1 wherein said arcuate intermediate member of said shoelace retaining clip means is made of a flexibly resilient material to facilitate selective maintaining of abutment between said abutment member and said base member in the steady state position.

3. A shoelace retaining clip means as defined in claim 2 wherein said upper member of said shoelace retaining clip means is also made of a flexibly resilient material to facilitate selective maintaining of abutment between said abutment member and said base member in the steady state position.

4. A shoelace retaining clip means as defined in claim 1 wherein said prying tab means of said shoelace retaining clip means is oriented at approximately forty-five degrees with respect to said base member.

5. A shoelace retaining clip means as defined in claim 1 wherein said arcuate intermediate member of said shoelace retaining clip means includes a convexly curved interior wall section therein immediately adjacent said shoelace retaining hole means for minimizing damaging of a shoelace retained therewithin.

6. A shoelace retaining clip means as defined in claim 1 wherein said base member of said shoelace retaining clip means defines at least one mounting eyelet means therein to facilitate securement thereof with respect to environmental surfaces.

7. A shoelace retaining clip means as defined in claim 6 wherein said base member of said shoelace retaining clip means defines two mounting eyelets therein to facilitate securement thereof with respect to environmental surfaces.

8. A shoelace retaining clip means as defined in claim 1 wherein said abutment member of said shoelace retaining clip means includes a convexly shaped abutment surface adapted to contact said base member directly.

9. A shoelace retaining clip means as defined in claim 1 wherein said base member, said arcuate intermediate member, said upper member and said abutment member of said shoelace retaining clip means are all integrally formed with respect to one another and are made of a flexibly resilient material.

10. A shoelace retaining clip means as defined in claim 1 wherein said base member, said arcuate intermediate member, said upper member and said abutment member of said shoelace retaining clip means are all integrally formed with respect to one another and are made of a flexibly resilient stainless steel.

11. A shoelace retaining clip means as defined in claim 1 wherein said base member, said arcuate intermediate member, said upper member and said abutment member of said shoelace retaining clip means are all integrally formed with respect to one another and are made of a flexibly resilient blue spring steel.

12. A shoelace retaining clip means as defined in claim 1 wherein said shoelace retaining clip means includes a plurality of shoelace retaining clips with each of said base members affixed to said footwear upper means along both sides of said elongated lacing gap means.

13. A shoelace retaining clip means as defined in claim 12 wherein said shoelace retaining clip means further includes a lowermost shoelace retaining clip positioned immediately below the lowermost end of said elongated lacing gap means to facilitate retaining thereof.

14. A shoelace retaining clip means as defined in claim 1 wherein said shoelace retaining clip means further includes a supplemental shoelace retaining clip positioned adjacent said foot opening means to facilitate retaining any extra length of said shoelace means after tightening thereof.

15. A shoelace retaining clip means as defined in claim 1 wherein said shoelace retaining clip means further includes a first supplemental shoelace retaining clip positioned adjacent one side of said foot opening means and a second supplemental shoelace retaining clip positioned adjacent the other side of said foot opening means to facilitate retaining any extra length of either end of said shoelace means after tightening thereof.

16. A shoelace retaining clip means as defined in claim 15 wherein said shoelace means includes an enlarged end member on each end thereof to facilitate retaining thereof within said shoelace securement clip means.

17. A shoelace retaining clip means as defined in claim 16 wherein said enlarged end member is larger than said shoelace retaining hole means to facilitate retaining of said shoelace means within said shoelace securement clip means.

18. A footwear construction with improved closure means for selective tightening thereof for facilitating attachment about the foot of a wearer as defined in claim 1 wherein said shoelace securement means includes:

A. a first cam cleat means mounted to said footwear upper means along said elongated lacing gap means for receiving one end of said shoelace means extending therethrough for selective securement therewithin; and B. a second cam cleat means mounted to said footwear upper means spatially disposed from said first cam cleat means and along said elongated lacing gap means for receiving the other end of said longitudinal lacing member extending therethrough for selective securement therewithin.

19. A footwear construction with improved closure means for selective tightening thereof for facilitating attachment about the foot of a wearer as defined in claim 18 wherein said first cam cleat means and said second cam cleat means are mounted upon said footwear upper means with said elongated lacing gap means positioned therebetween to facilitate tightening thereof responsive to securement of said shoelace means.

20. A footwear construction with improved closure means for selective tightening thereof for facilitating attachment about the foot of wearer as defined in claim 1 further comprising a guide ring means positioned between said cam cleat means of said shoelace securement means and said elongated lacing gap means, said guide ring means being adapted to receive said shoelace means extending therethrough to facilitate guiding and retaining thereof within said cam cleat means.

* * * * *